US005813476A

United States Patent [19]

Semper

[11] Patent Number: 5,813,476

[45] Date of Patent: Sep. 29, 1998

[54] BLADE MOUNTING STRUCTURE

[76] Inventor: Luis O. Semper, Apdo, 99 La Uruca, (1150) San Jose, Costa Rica

[21] Appl. No.: 744,304

[22] Filed: Nov. 6, 1996

[51] Int. Cl.[6] ..... E02F 3/76

[52] U.S. Cl. ..... 172/822; 172/823; 172/831

[58] Field of Search ..... 172/811, 818, 172/819, 820, 821, 822, 823, 824, 825, 828, 830, 831

[56] References Cited

U.S. PATENT DOCUMENTS

| | | | |
|---|---|---|---|
| Re. 21,447 | 5/1940 | Allin . | |
| 2,108,466 | 2/1938 | Allin et al. | 172/823 |
| 2,832,158 | 4/1958 | Piontek | 172/831 |
| 2,853,812 | 9/1958 | Van Riet et al. | 172/818 |
| 3,222,804 | 12/1965 | Kuhl | 172/827 |
| 3,234,670 | 2/1966 | Fryer et al. | 172/827 |
| 3,246,406 | 4/1966 | Ray, Jr. | 172/822 |
| 3,515,224 | 6/1970 | Seaberg . | |
| 3,543,867 | 12/1970 | Smemo et al. . | |
| 3,897,833 | 8/1975 | Frisbee . | |
| 3,912,097 | 10/1975 | Turner et al. . | |
| 4,078,616 | 3/1978 | Hisamatsu et al. . | |
| 4,311,200 | 1/1982 | Lebedev et al. | 172/826 |
| 5,010,961 | 4/1991 | Frisbee | 172/821 |
| 5,462,125 | 10/1995 | Stratton et al. | 172/826 |

*Primary Examiner*—Terry Lee Melius
*Assistant Examiner*—Christopher J. Novosad
*Attorney, Agent, or Firm*—Aquilino & Welsh

[57] ABSTRACT

A bulldozer blade mounting structure is disclosed. The mounting structure includes a first pivot arm having a first end adapted for pivotal attachment to a tractor and a second end coupled to a bulldozer blade, and a second pivot arm having a first end adapted for pivotal attachment to a tractor and a second end coupled to a bulldozer blade. The mounting structure also includes a first coupling joint coupling the second end of the first pivot arm to the bulldozer blade, wherein the first coupling joint permits the bulldozer blade to rotate about a longitudinal axis of the first pivot arm and to rotate about an axis substantially perpendicular to the longitudinal axis of the first pivot arm. The mounting structure is also provided with a second coupling joint coupling the second end of the first pivot arm to the bulldozer blade, wherein the second coupling joint permits the bulldozer blade to rotate about a longitudinal axis of the second pivot arm and to rotate about an axis substantially perpendicular to the longitudinal axis of the second pivot arm. The mounting structure is further provided with a first actuator having a first end adapted for attachment to a tractor and a second end pivotally secured to the first coupling joint, and a second actuator having a first end adapted for attachment to a tractor and a second end pivotally secured to the second coupling joint.

19 Claims, 7 Drawing Sheets

BLADE MOUNTING STRUCTURE

BACKGROUND OF THE INVENTION

1. Field of the Invention

The invention relates to mounting structures for bulldozer blades. More particularly, the invention relates to mounting structures for bulldozer blades which permit the blade to rotate about both horizontal and vertical axes, as well as pivot up and down.

2. Description of the Prior Art

Bulldozing blades are commonly utilized on a variety of tractors from large earthmoving machines to small tractors commonly used by homeowners to cut their lawns. With this in mind, a variety of assemblies are known for mounting the bulldozing blades to the appropriate tractor.

Many of these mounting structures permit the individual to move the blade in a variety of predetermined paths. Mounting structures are commonly provided with hydraulic or pneumatic cylinders coupled to the bulldozing blade in a manner causing the blade to move in a predetermined path when the cylinders are actuated by a user. When the cylinders are secured to the bulldozers by a series of connections, the bulldozing blades may be maneuvered up and down. In addition, the bulldozing blades may be rotated about a horizontal axis and a vertical axis.

More complicated mounting structures are generally permanently secured to tractors and are designed for use with only specific tractors. While these bulldozers offer sophisticated mounting structures for their blades, the bulldozers are very expensive and not economically feasible for many individuals who only occasionally use a bulldozer blade. In addition, most of these bulldozers are rather slow and, therefore, expensive to transport from location to location. As a result, one would be forced to leave the bulldozer at a location and run the risk of having parts from the bulldozer stolen while the bulldozer sat at the location overnight.

Unfortunately, these prior mounting structures are cumbersome and rely upon an extensive system of joints, arms, and actuators to achieve the desired movements. As such, they are not readily adaptable for use with other tractors. When one studies mounting structures available for use in mounting a bulldozer blade to a common tractor, the problems associated with prior mounting structures become especially pronounced. Specifically, mounting structures currently available do not allow the operator to fully utilize the weight and traction of the tractor. In addition, the range of movement provided by the mounting structures is substantially limited.

With the limitation of prior bulldozer blade mounting structures in mind, it is apparent that a need continues to exist for a convenient, reliable, and inexpensive mounting structure for securing a bulldozer blade to a tractor. The present invention provides such a mounting structure.

SUMMARY OF THE INVENTION

It is, therefore, an object of the present invention to provide a bulldozer blade mounting structure. The mounting structure includes a first pivot arm having a first end adapted for pivotal attachment to a tractor and a second end coupled to a bulldozer blade, and a second pivot arm having a first end adapted for pivotal attachment to a tractor and a second end coupled to a bulldozer blade. The mounting structure also includes a first coupling joint coupling the second end of the first pivot arm to the bulldozer blade, wherein the first coupling joint permits the bulldozer blade to rotate about a longitudinal axis of the first pivot arm and to rotate about an axis substantially perpendicular to the longitudinal axis of the first pivot arm. The mounting structure is also provided with a second coupling joint coupling the second end of the first pivot arm to the bulldozer blade, wherein the second coupling joint permits the bulldozer blade to rotate about a longitudinal axis of the second pivot arm and to rotate about an axis substantially perpendicular to the longitudinal axis of the second pivot arm. The mounting structure is further provided with a first actuator having a first end adapted for attachment to a tractor and a second end pivotally secured to the first coupling joint, and a second actuator having a first end adapted for attachment to a tractor and a second end pivotally secured to the second coupling joint. Movement of the first actuator and the second actuator is used to cause predetermined movement of the bulldozer blade.

It is another object of the present invention to provide a coupling joint used to secure a bulldozer blade to a mounting structure, wherein the mounting structure includes at least one pivot arm and at least one actuator. The coupling joint includes a first end having a circular, recessed bearing surface shaped to receive the pivot arm in a manner permitting the coupling joint to rotate about a longitudinal axis of the pivot arm and a second end having a mounting bracket for selectively securing the coupling joint to the bulldozer blade in a variety of orientations. The coupling joint also includes a hinge connecting the first end of the coupling joint and the second end of the coupling joint. The hinge has an axis of rotation substantially perpendicular to the longitudinal axis of the pivot arm. The coupling joint further includes a mounting platform offset toward an outer edge of the bulldozer blade from a vertical plane passing through the longitudinal axis of the pivot arm, wherein the mounting platform includes structure for pivotally coupling the actuator thereto.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
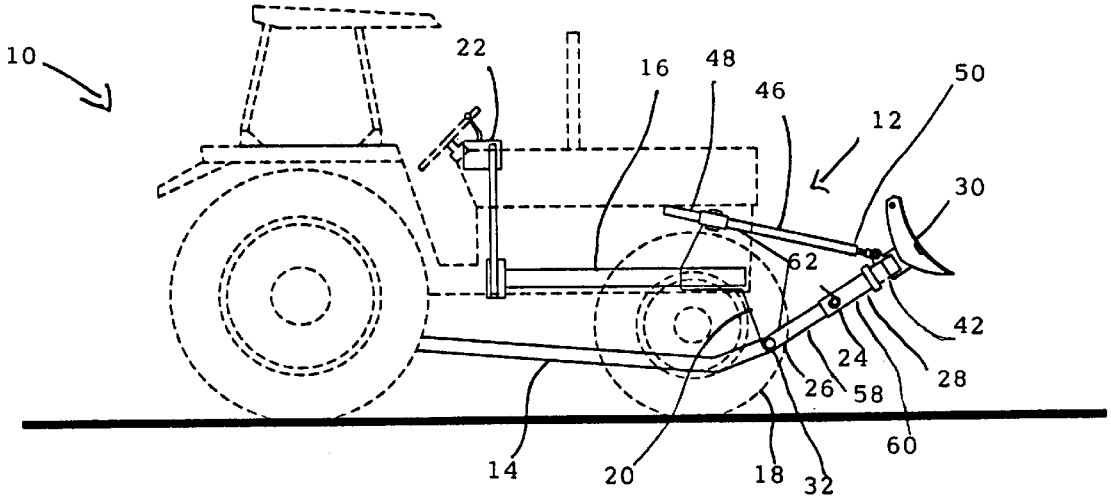
FIG. 1 is a side view of the mounting structure secured to a tractor.
Figure 2:
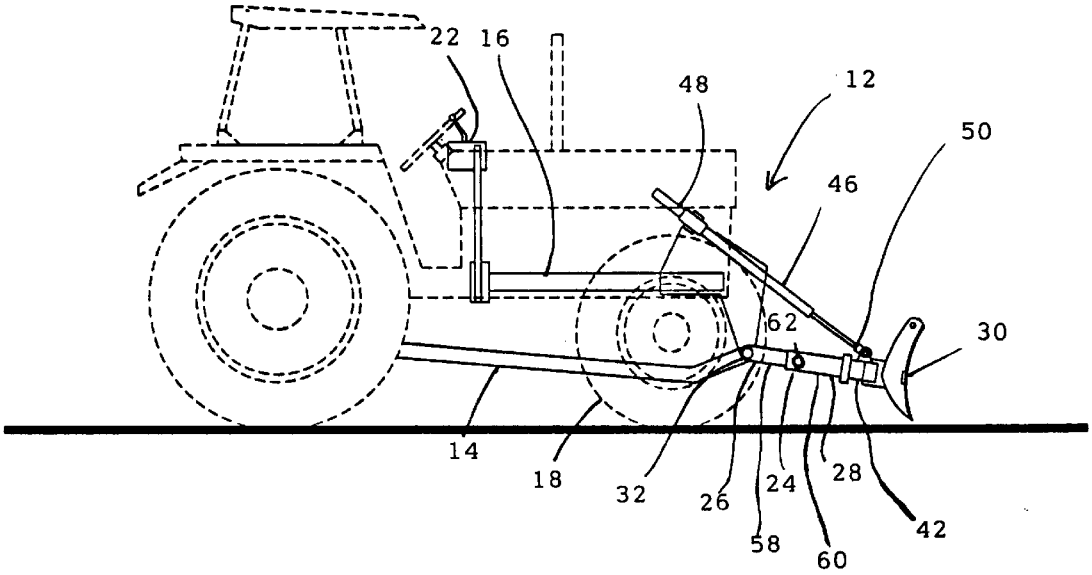
FIG. 2 is a side view of the mounting structure secured to a tractor, wherein the bulldozer blade is positioned adjacent the ground.
Figure 3:
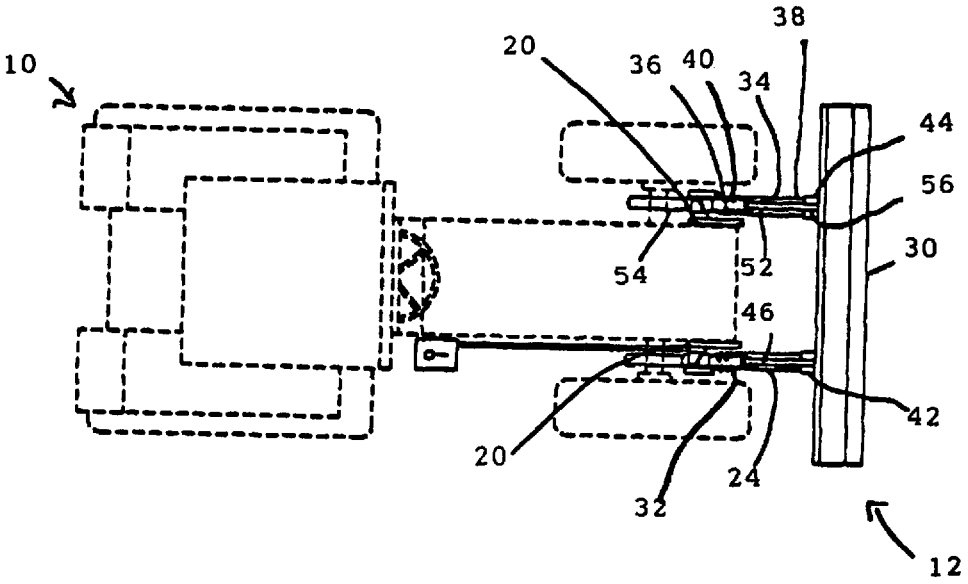
FIG. 3 is a top view of the mounting structure secured to the tractor.
Figure 13:
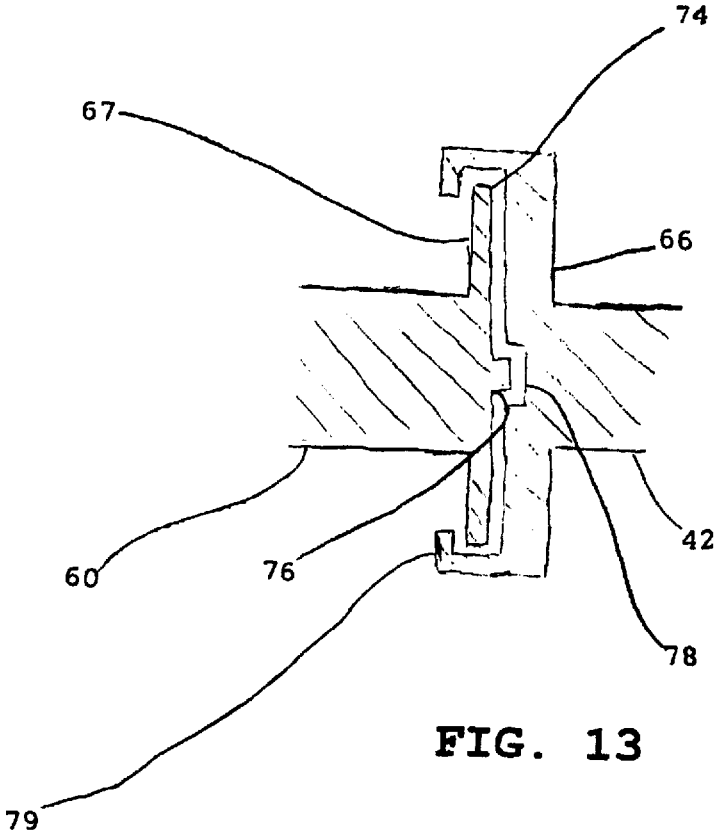
FIG. 13 is a cross-sectional view showing the second pivot arm member secured within the first end of the first coupling joint.
Figure 4:
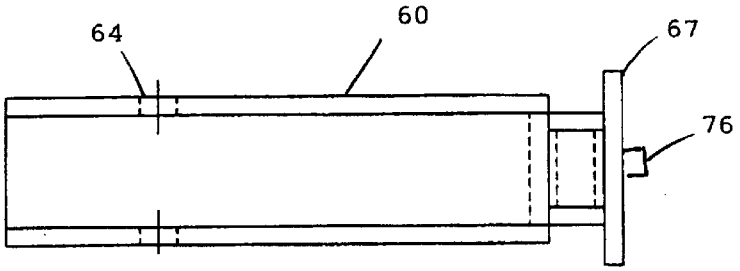
FIG. 4 is a top view of the second pivot arm member.
Figure 5:
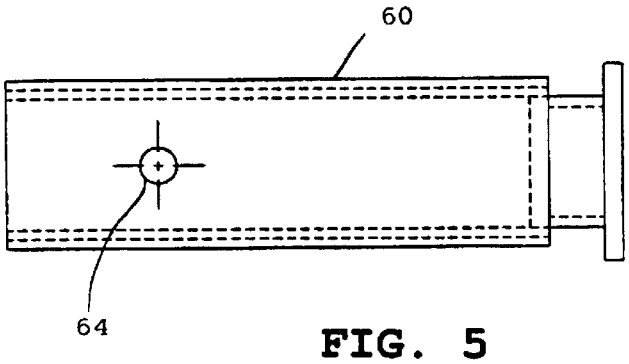
FIG. 5 is a side view of the second pivot arm member.
Figure 6:
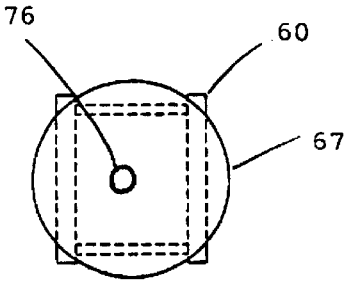
FIG. 6 is a front view of the second pivot arm member.
Figure 7:
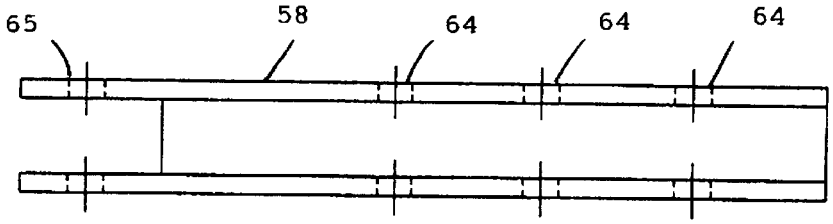
FIG. 7 is a top view of the first pivot arm member.
Figure 8:
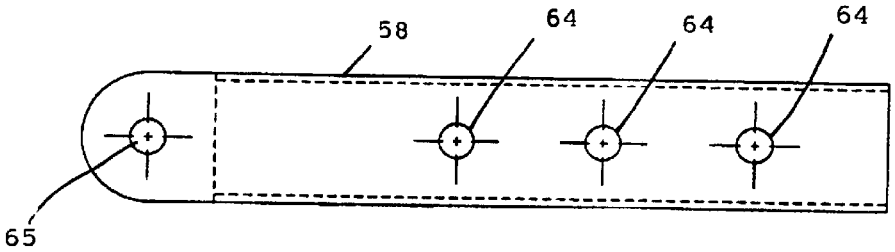
FIG. 8 is a side view of the first pivot arm member.
Figure 9:
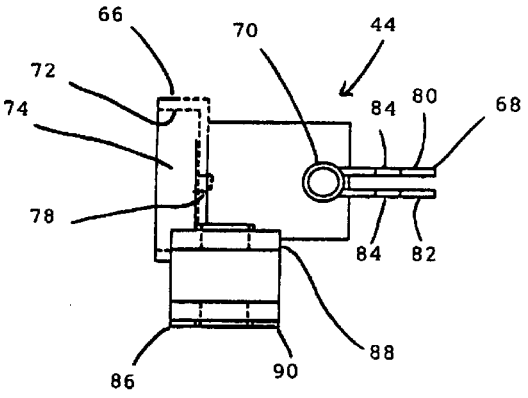
FIG. 9 is a top view of the first coupling joint.
Figure 10:
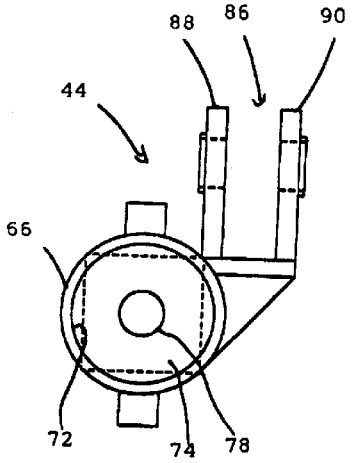
FIG. 10 is a front view of the first coupling joint.
Figure 11:
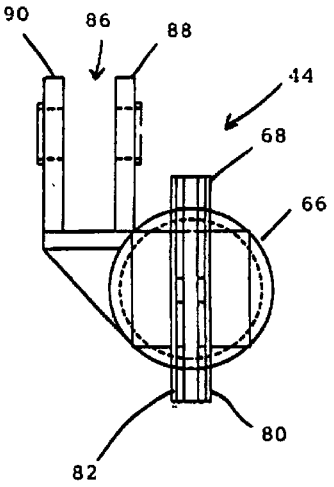
FIG. 11 is a rear view of the first coupling joint.
Figure 12:
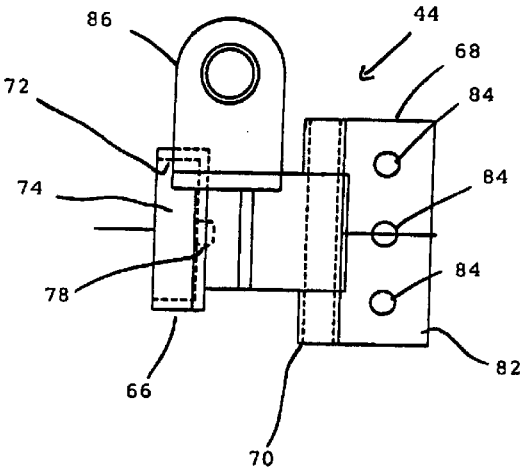
FIG. 12 is a side view of the first coupling joint.

With reference to FIGS. 1 to 3, a common tractor 10 having the bulldozer blade mounting structure 12 secured thereto is disclosed. The tractor 10 is conventional and includes a body with an elongated forward section to which the mounting structure is secured.

The mounting structure 12 includes first and second support brackets 14, 16 on both sides of the tractor. The first support bracket 14 extends below the front wheel 18 of the tractor 10 and is securely mounted to the body of the tractor 10 in a conventional manner. The second support bracket 16 extends above the wheel 18 of the tractor 10 and is securely mounted to the body of the tractor in a conventional manner. The distal ends of the first and second support brackets are connected by a support plate 20 to which the functional elements of the mounting structure 12 are secured in a manner that will be discussed in greater detail below.

The second support bracket 16 supports the hydraulic control assembly 22. The hydraulic control assembly 22 is utilized to actuate the mounting structure 12 in a manner that will be discussed in greater detail below. As should be appreciated by one of ordinary skill in the art, the first and second support brackets, as well as the support plate, are simply provided to support the functional elements of the mounting structure 12 that will be discussed in detail below, and may be modified or replaced without departing from the spirit of the invention.

With regard to the functional elements, the mounting structure 12 includes a first pivot arm 24 having a first end 26 adapted for pivotal attachment to one side of the support plate 20 and a second end 28 coupled to a bulldozer blade 30. A pivot pin 32 pivotally secures the first end of the first pivot arm to the support plate. The mounting structure 12 also includes a second pivot arm 34 having a first end 36 adapted for pivotal attachment to the other side of a tractor 10 and a second end 38 coupled to the bulldozer blade 30. As with the first end 26 of the first pivot arm 24, a pivot pin 40 pivotally secures the first end 36 of the first pivot arm 34 to the support plate 20.

The mounting structure 12 further includes a first coupling joint 42 coupling the second end 28 of the first pivot arm 24 to the bulldozer blade 30. The first coupling joint 42 permits the bulldozer blade 30 to rotate about a longitudinal axis of the first pivot arm 24 and to rotate about an axis substantially perpendicular to the longitudinal axis of the first pivot arm 24. Similarly, the mounting structure 12 includes a second coupling joint 44 coupling the second end 38 of the second pivot arm 34 to the bulldozer blade 30. The second coupling joint 44 permits the bulldozer blade 30 to rotate about a longitudinal axis of the second pivot arm 34 and to rotate about an axis substantially perpendicular to the longitudinal axis of the second pivot arm 34.

The blade 30 is moved by the provision of a first actuator 46 having a first end 48 adapted for pivotal attachment to the tractor 10 and a second end 50 pivotally secured to the first coupling joint 42. The mounting structure 12 is also provided with a second actuator 52 having a first end 54 adapted for pivotal attachment to the tractor 10 and a second end 56 pivotally secured to the second coupling joint.

As should be appreciated from the brief description provided above, the mounting structure 12 is symmetrically constructed with first and second elements on opposite sides of the tractor 10. As such, only the elements found on one side of the tractor will be discussed in detail. It should be understood that the other set of elements are identical to those described below, with the exception that the other set of elements are mirror images of the first set of elements described below.

With reference to FIGS. 4 to 8, the first pivot arm 24 includes a first pivot arm member 58 and a second pivot arm member 60. The first pivot arm member 58 is telescopically received within the second pivot arm member 60. Both the first pivot arm member 58 and the second pivot arm member 60 have a substantially square cross-sectional shape to prevent rotation between the two members. The first pivot arm member 58 and the second pivot arm member 60 are selectively locked in a variety of preselected lengths by a locking pin 62 shaped to pass through a series of aligned holes 64 formed in both the first pivot arm member 58 and the second pivot arm member 60.

As stated above, the free end of the first pivot arm member 58 (i.e., the first end 26 of the first pivot arm 24) includes a hole 65 through which a pivot pin 32 passes to pivotally secure the first pivot arm 24 to the support plate 20, and ultimately to the tractor 10. The free end 67 of the second pivot arm member 60 (i.e., the second end 28 of the first pivot arm 24) has a circular shape for attachment to the first coupling joint 42.

Referring to FIGS. 9 to 15, the first coupling joint 42 includes a first end 66 and a second end 68. The first and second ends 66, 68 are coupled by a hinge 70, permitting the first and second ends 66, 68 of the first coupling joint 42 to pivot about an axis substantially perpendicular to the longitudinal axis of the first coupling joint 42 (as defined when the first and second ends of the first coupling joint are aligned).

With reference to the first end 66 of the first coupling joint 42, a bearing surface 72 shaped to receive the second end 28 of the first pivot arm 24 is provided. Specifically, the first end 66 of the first coupling joint 42 includes a circularly shaped recess 74 into which the second end 28 of the first pivot arm 24 is positioned. The first end 66 of the first coupling joint 42 and the second end 28 of the first pivot arm 24 are rotatably coupled by a first coupling structure. The first coupling structure rotatably couples the second end 28 of the first pivot arm 24 to the first end 66 of the first coupling joint 42. The first coupling structure includes a first central pin 76 extending from the end of the second end 28 of the first pivot arm 24 and a central opening 78 in the first coupling joint 42 shaped to receive the first central pin 76 for rotatably coupling the first pivot arm 24 to the first joint coupling 42. The second end 28 of the first pivot arm 24 is securely held within the first coupling joint 42 by the provision of a lip 79 (see FIG. 13) welded about the periphery of the recess 74. As a result, the first coupling joint 42 may rotate about an axis substantially parallel to the longitudinal axis of the first pivot arm 24. Similarly, the hinge 70 will rotate about an axis substantially perpendicular to the longitudinal axis of the first pivot arm 24.

The second end 68 of the first coupling joint 42 includes first and second plates 80, 82 shaped to be received within mounting plates (not shown) on the backside of the bulldozer blade 30. The first and second plates 80, 82 include a series of holes 84 designed for alignment with holes formed in the mounting plates on the backside of the bulldozer blade 30. As a result, the second end 68 of the first coupling joint 42 is bolted to the mounting plates on the bulldozer blade 30. The mounting plates on the bulldozer blade 30 are provided with a variety of holes, permitting the bulldozer blade 30 to be secured to the first coupling joint 42 in a variety of orientations by selectively aligning the holes 84 of the mounting plates with the holes of the first and second plates 80, 82 such that the bulldozer blade 30 is properly oriented for the user's needs. While the preferred embodiment includes a pair of plates for attachment to the bulldozer blade, other configurations could be utilized, depending upon the structure of the blade, without departing from the spirit of the present invention.

The first coupling joint 42 is also provided with a first mounting platform 86 offset toward an outer edge of the bulldozer blade 30 from a vertical plane passing through the longitudinal axis of the first pivot arm 42. The first actuator is pivotally coupled to the first mounting platform 86 in a manner that will be discussed in greater detail below.

Figure 14:
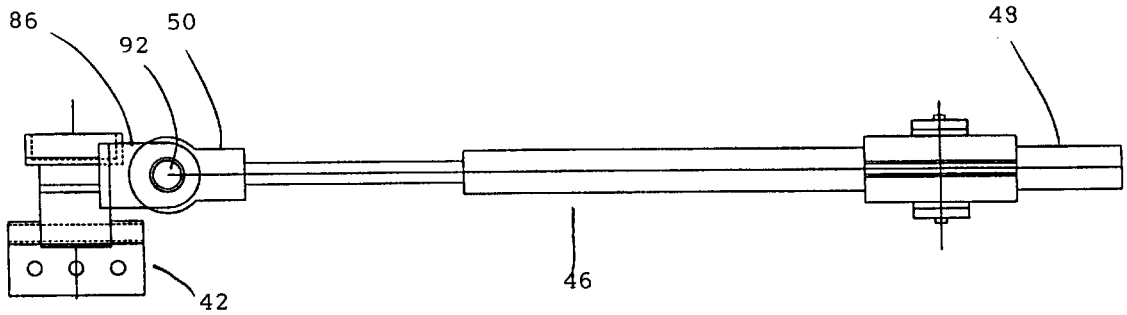
FIG. 14 is a top view showing the first actuator secured to the first coupling joint.
Figure 15:
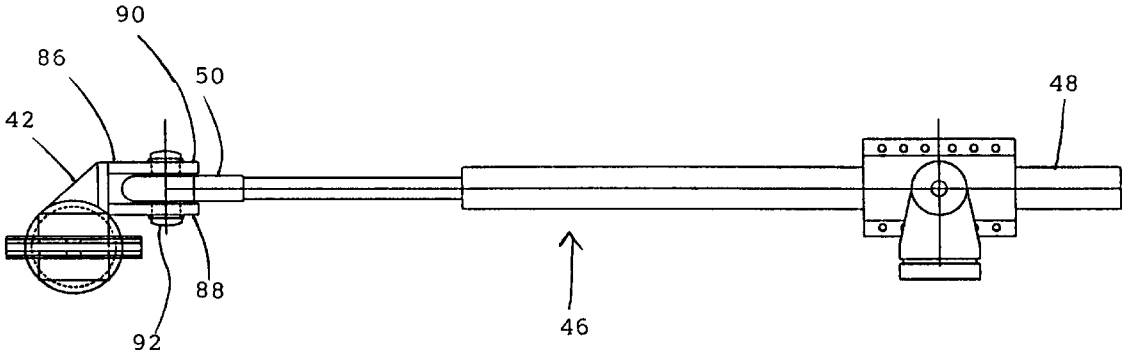
FIG. 15 is a side view showing the first actuator secured to the first coupling joint.

With regard to the first actuator 46 as shown in FIGS. 14 and 15, the first end 48 of the first actuator 46 is pivotally coupled to the support plate 20 and the second end 50 of the actuator 46 is pivotally coupled to the first mounting platform 86 of the first pivot arm 42. The first mounting platform 86 includes a pair of ears 88, 90 supporting a pivot pin 92 which pivotally couples the second end 50 of the actuator 46 to the first mounting platform 86. The actuator 46 is preferably a hydraulic piston, however, other actuators could be used without departing from the spirit of the present invention.

In use, the bulldozer blade may be moved to rotate about a substantially vertical axis and to rotate about a substantially horizontal axis. In addition, the tilt of the bulldozer blade relative to the first and second coupling joints may be adjusted. The bulldozer blade may also be moved up and down in a circular arc.

Figure 16:
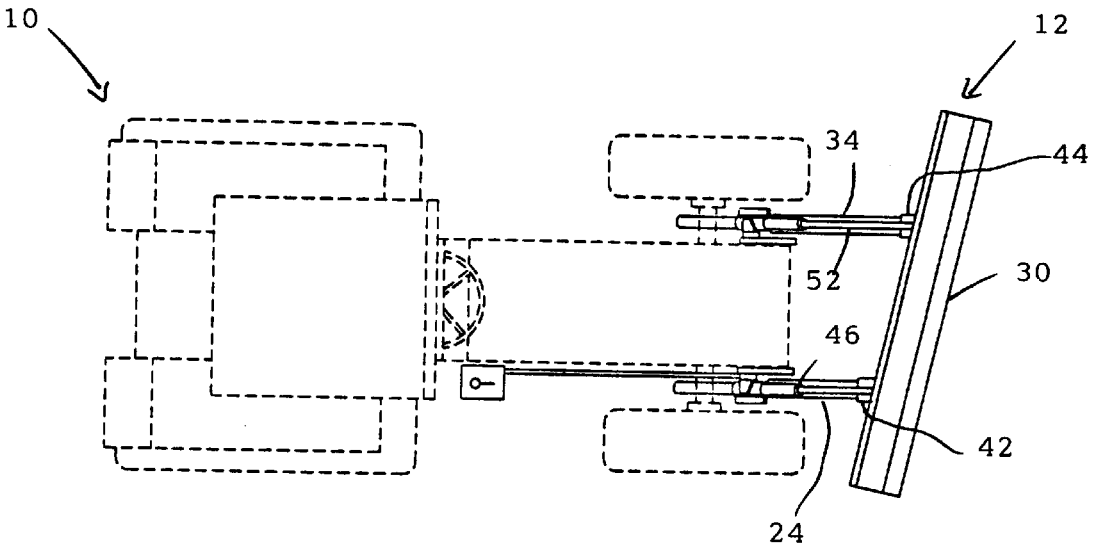
FIG. 16 is a top view of the mounting structure with the bulldozer blade pivoted about a vertical axis.

With regard to rotation about a substantially vertical axis, a user adjusts the bulldozer blade by selectively extending or retracting the first and second pivot arms. Specifically, when one of the pivot arms is telescopically adjusted such that it is longer or shorter relative to the other pivot arm, the bulldozer blade is shifted and rotates about a substantially vertical axis (that is, it rotates about a vertical axis when the blade is sitting on a flat surface). With reference to FIG. 16, if an individual wishes the bulldozer blade to be oriented at a 45° angle with respect to the longitudinal axis of the tractor, the user simply extends either pivot arm until the bulldozer blade is at the desired orientation. When the blade is at its desired orientation, the locking pin is inserted into the pivot arm to lock the bulldozer blade in the desired position. Rotation of the bulldozer blade is facilitated by the provision of the first and second hinges of the first and second coupling joints, respectively.

Figure 17:
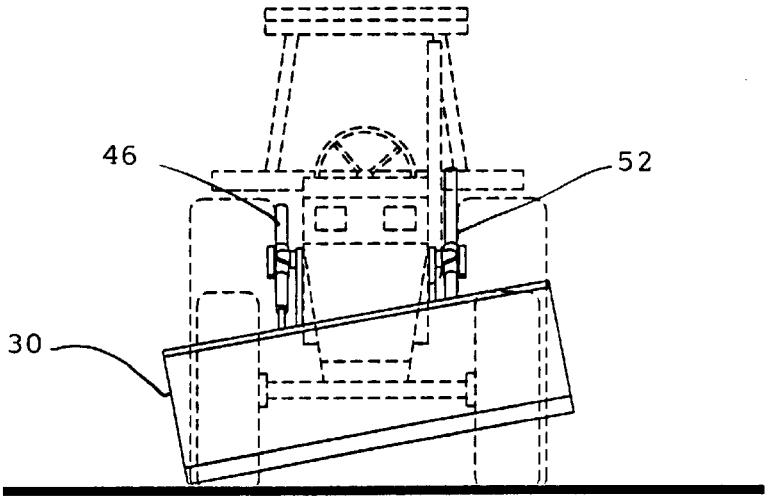
FIG. 17 is a front view of the mounting structure showing the bulldozer blade pivoted about a horizontal axis.

As to rotation about a substantially horizontal axis, extension or retraction of the first and/or second actuators provides the forces necessary to rotate the bulldozer blade about a substantially horizontal axis. It should be understood, that the phrase rotation about a horizontal axis refers to the rotation of the bulldozer blade in a plane as shown in FIG. 17. As one of ordinary skill in the art will appreciate, the plane in which the bulldozer blade rotates will vary slightly depending upon the position of the blade relative to the tractor when the actuators are used to rotate the blade.

With reference to FIG. 17, rotation of the bulldozer blade about a substantially horizontal axis is achieved by extending or retracting one or both of the actuators such that the actuators have different lengths. When the actuators are controlled such that they have different lengths, the blade is rotated. Rotation of the bulldozer blade in this manner is permitted by the provision of the rotational couplings between the second end of the first and second pivot arms and the first ends of the first and second coupling joints.

Figure 18:
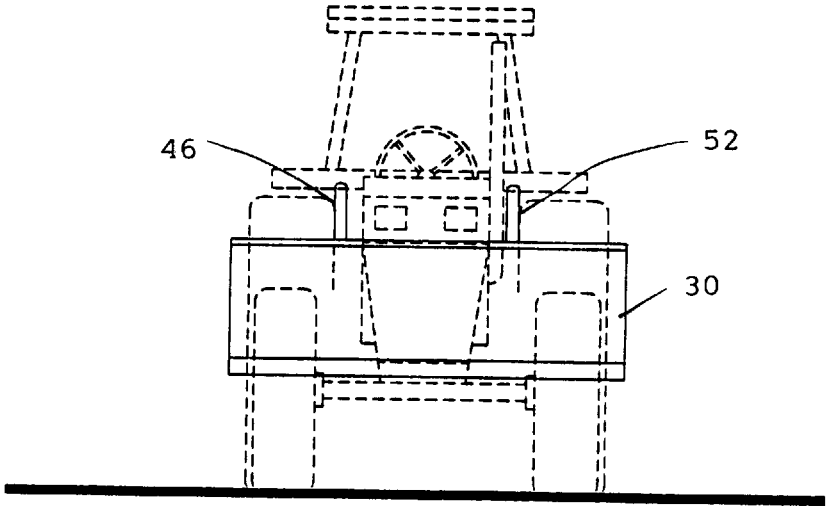
FIGS. 18 and 19 are front views of the mounting structure respectively showing the bulldozer blade lifted and positioned adjacent the surface.
Figure 19:
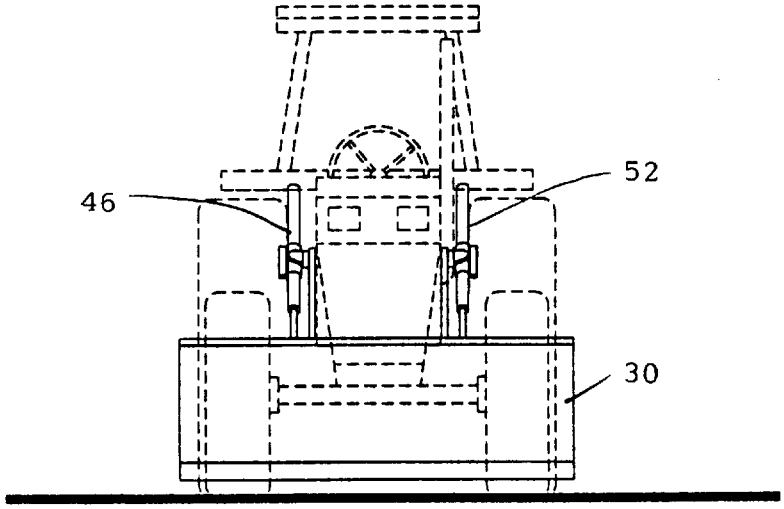

In addition to the rotation of the blade through the use of the actuators, the bulldozer blade may be lifted by the actuators. Specifically, when both actuators are extended or retracted at the same time and at the same rate, the bulldozer blade is lifted upward or downward in a circular arc (see FIGS. 18 and 19).

While the preferred embodiment has been shown and described, it will be understood that there is no intent to limit the invention by such disclosure, but rather, is intended to cover all modifications and alternate constructions falling within the spirit and scope of the invention as defined in the appended claims.

I claim:

1. A bulldozer blade mounting structure, comprising:

a first pivot arm having a first end adapted for pivotal attachment to a tractor and a second end coupled to a bulldozer blade;

a second pivot arm having a first end adapted for pivotal attachment to a tractor and a second end coupled to a bulldozer blade;

a first coupling joint coupling the second end of the first pivot arm to the bulldozer blade, the first coupling joint permitting the bulldozer blade to rotate about a longitudinal axis of the first pivot arm and to rotate about an axis substantially perpendicular to the longitudinal axis of the first pivot arm;

a second coupling joint coupling the second end of the second pivot arm to the bulldozer blade, the second coupling joint permitting the bulldozer blade to rotate about a longitudinal axis of the second pivot arm and to rotate about an axis substantially perpendicular to the longitudinal axis of the second pivot arm;

a first actuator having a first end adapted for attachment to a tractor and a second end pivotally secured to the first coupling joint;

a second actuator having a first end adapted for attachment to a tractor a second end pivotally secured to the second coupling joint;

wherein movement of the first actuator and the second actuator is used to cause predetermined movement of the bulldozer blade.

2. The mounting structure according to claim 1, wherein the second end of the first pivot arm is circularly shaped and the first coupling joint includes a circular bearing surface shaped to receive the second end of the first pivot arm in a manner permitting the first coupling joint to rotate about the longitudinal axis of the first pivot arm; and the second end of the second pivot arm is circularly shaped and the second coupling joint includes a circular bearing surface shaped to receive the second end of the second pivot arm in a manner permitting the second coupling joint to rotate about the longitudinal axis of the second pivot arm.

3. The mounting structure according to claim 2, wherein the first coupling joint includes a hinge oriented to rotate about an axis substantially perpendicular to the longitudinal axis of the first pivot arm and the second coupling joint includes a hinge oriented to rotate about an axis substantially perpendicular to the longitudinal axis of the second pivot arm.

4. The mounting structure according to claim 1, wherein the first coupling joint includes a first hinge oriented to rotate about an axis substantially perpendicular to the longitudinal axis of the first pivot arm and the second coupling joint includes a second hinge oriented to rotate about an axis substantially perpendicular to the longitudinal axis of the second pivot arm.

5. The mounting structure according to claim 1, wherein the first coupling joint includes a first mounting bracket for selectively securing the bulldozing blade to the first coupling joint in a variety of orientations and the second coupling joint includes a second mounting bracket for selectively securing the bulldozing blade to the second coupling joint in a variety of orientations.

6. The mounting structure according to claim 1, wherein the first pivot arm is selectively extendable and the second pivot arm is selectively extendable, thereby permitting the bulldozing blade to be pivoted about a horizontal axis.

7. The mounting structure according to claim 1, wherein the first actuator and the second actuator are hydraulic pistons.

8. The mounting structure according to claim 1, wherein the first actuator is pivotally coupled to the first coupling joint and the second actuator is pivotally coupled to the second coupling joint.

9. The mounting structure according to claim 8, wherein the first coupling joint includes a first mounting platform offset toward an outer edge of the bulldozer blade from a vertical plane passing through the longitudinal axis of the first pivot arm and the first actuator is pivotally coupled to the first mounting platform; and wherein the second coupling joint includes a second mounting platform offset toward an outer edge of the bulldozer blade from a vertical plane passing through the longitudinal axis of the second pivot arm and the second actuator is pivotally coupled to the second mounting platform.

10. A bulldozer blade mounting structure, comprising:

a first pivot arm having a first end adapted for pivotal attachment to a tractor and a second end coupled to a bulldozer blade;

a second pivot arm having a first end adapted for pivotal attachment to a tractor and a second end coupled to a bulldozer blade;

a first coupling joint coupling the second end of the first pivot arm to the bulldozer blade, the first coupling joint permitting the bulldozer blade to rotate about a longitudinal axis of the first pivot arm and to rotate about an axis substantially perpendicular to the longitudinal axis of the first pivot arm, wherein the second end of the first pivot arm is circular shaped and the first coupling joint includes a circular bearing surface shaped to receive the second end of the first pivot arm in a manner permitting the first coupling joint to rotate about the longitudinal axis of the first pivot arm;

a second coupling joint coupling the second end of the second pivot arm to the bulldozer blade, the second coupling joint permitting the bulldozer blade to rotate about a longitudinal axis of the second pivot arm and to rotate about an axis substantially perpendicular to the longitudinal axis of the second pivot arm, wherein the second end of the second pivot arm is circular shaped and the second coupling joint includes a circular bearing surface shaped to receive the second end of the second pivot arm in a manner permitting the second coupling joint to rotate about the longitudinal axis of the second pivot arm;

a first actuator coupled between a tractor and the bulldozing blade;

a second actuator coupled between a tractor and the bulldozing blade;

wherein movement of the first actuator and the second actuator is used to cause predetermined movement of the bulldozer blade.

11. The mounting structure according to claim 10, wherein the first coupling joint includes a hinge oriented to rotate about an axis substantially perpendicular to the longitudinal axis of the first pivot arm and the second coupling joint includes a hinge oriented to rotate about an axis substantially perpendicular to the longitudinal axis of the second pivot arm.

12. The mounting structure according to claim 10, wherein first coupling means are provided for rotatably coupling the second end of the first pivot arm to the first coupling joint and second coupling means are provided for rotatably coupling the second end of the second pivot arm to the second coupling joint.

13. The mounting structure according to claim 12, wherein the first coupling means includes a first central pin extending from the end of the second end of the first pivot arm and a central opening in the first coupling joint shaped to receive the first central pin for rotatably coupling the first pivot arm to the first coupling joint; and the second coupling means includes a second central pin extending from the end of the second end of the second pivot arm and a central opening in the second coupling joint shaped to receive the second central pin for rotatably coupling the second pivot arm to the second coupling joint.

14. The mounting structure according to claim 10, wherein the first coupling joint includes a first end and a second end, and the second end of the first coupling joint includes a first mounting bracket for selectively securing the bulldozing blade to the first coupling joint in a variety of orientations and the second couple joint includes a first end and a second end, and the second end of the second coupling joint includes a second mounting bracket for selectively securing the bulldozing blade to the second coupling joint in a variety of orientations.

15. The mounting structure according to claim 10, wherein the first pivot arm is selectively extendable and the second pivot arm is selectively extendable, thereby permitting the bulldozing blade to be pivoted about a horizontal axis.

16. The mounting structure according to claim 10, wherein the first actuator and the second actuator are hydraulic pistons.

17. The mounting structure according to claim 10, wherein the first actuator is pivotally coupled to the first coupling joint and the second actuator is pivotally coupled to the second coupling joint.

18. The mounting structure according to claim 17, wherein the first coupling joint includes a first mounting platform offset toward an outer edge of the bulldozer blade from a vertical plane passing through the longitudinal axis of the first pivot arm and the first actuator is pivotally coupled to the first mounting platform; and wherein the second coupling joint includes a second mounting platform offset toward an outer edge of the bulldozer blade from a vertical plane passing through the longitudinal axis of the second pivot arm and the second actuator is pivotally coupled to the second mounting platform.

19. A coupling joint used to secure a bulldozer blade to a mounting structure, wherein the mounting structure includes at least one pivot arm and at least one actuator, the coupling joint comprising:

a first end including a circular, recessed bearing surface shaped to receive the pivot arm in a manner permitting the coupling joint to rotate about a longitudinal axis of the pivot arm;

a second end including a mounting bracket for selectively securing the coupling joint to the bulldozer blade in a variety of orientations;

a hinge connecting the first end of the coupling joint and the second end of the coupling joint, the hinge having an axis of rotation substantially perpendicular to the longitudinal axis of the pivot arm;

a mounting platform offset toward an outer edge of the bulldozer blade from a vertical plane passing through the longitudinal axis of the pivot arm, the mounting platform including means for pivotally coupling the actuator thereto.

* * * * *